US011066205B2

(12) United States Patent
Harvey et al.

(10) Patent No.: US 11,066,205 B2
(45) Date of Patent: Jul. 20, 2021

(54) HYGIENIC LABELING MACHINE

(71) Applicant: MULTIFEEDER TECHNOLOGY, INC., White Bear Lake, MN (US)

(72) Inventors: Curtis Allen Harvey, Hugo, MN (US); Peter M. Nordling, Shoreview, MN (US); Ed Turin, Eagan, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 0 days.

(21) Appl. No.: 16/893,907

(22) Filed: Jun. 5, 2020

(65) Prior Publication Data

US 2021/0039821 A1 Feb. 11, 2021

Related U.S. Application Data

(60) Provisional application No. 62/885,065, filed on Aug. 9, 2019.

(51) Int. Cl.

| | |
|---|---|
| ***B65C 9/42*** | (2006.01) |
| ***B65C 9/32*** | (2006.01) |
| ***B65C 9/18*** | (2006.01) |
| ***B65C 9/02*** | (2006.01) |

(52) U.S. Cl.

CPC ..... *B65C 9/42* (2013.01); *B65C 9/02* (2013.01); *B65C 9/1892* (2013.01); *B65C 9/32* (2013.01)

(58) Field of Classification Search

CPC ..... B65C 9/02; B65C 9/1892; B65C 9/32; B65C 9/40; B65C 9/42

See application file for complete search history.

(56) References Cited

U.S. PATENT DOCUMENTS

2011/0109047 A1* 5/2011 Tones ..... F16J 15/3244 277/412

2015/0291302 A1* 10/2015 McNestry ..... B65C 9/1892 156/64

(Continued)

FOREIGN PATENT DOCUMENTS

FR 2825342 A1 * 12/2002 ..... B65C 9/00

OTHER PUBLICATIONS

Translation of FR-2825342-A1, Inventor Barbosa Valdemar, Dec. 2002 (Year: 2002).*

*Primary Examiner* — George R Koch

(74) *Attorney, Agent, or Firm* — Thomas J. Nikolai; DeWitt LLP

(57) ABSTRACT

A high speed labeling machine especially designed for use in food or pharmaceutical processing environments. It can be periodically washed down in accordance with applicable governmental standards without entry of washing fluid into an interior of an enclosure assembly containing servo motors and the electronics for driving shafts that penetrate through a wall of the enclosure assembly and on which a label web supply reel and a web take-up reel are removably mounted. A plurality of idler rollers and a pinch roller are used to route the label carrying web from the supply reel, over an edge of a peel plate, where the labels are separated from the web, and back to the web take-up reel. The idler rollers and the pinch rollers are journaled on shafts in a way precluding entry of wash fluids into their interior. The enclosure assembly is cantilever-mounted on a jack stand for vertical adjustment relative to items to be labeled.

19 Claims, 14 Drawing Sheets

(56) References Cited

U.S. PATENT DOCUMENTS

| | | | | |
|---|---|---|---|---|
| 2016/0376047 | A1* | 12/2016 | Reed | B65B 57/10<br>156/64 |
| 2018/0128380 | A1* | 5/2018 | Tones | F16J 15/4478 |
| 2018/0265239 | A1* | 9/2018 | Riva | B65C 1/021 |

* cited by examiner

HYGIENIC LABELING MACHINE

CROSS-REFERENCED TO RELATED APPLICATIONS

This application is a non-provisional application of Application No. 62/885,065, filed Aug. 9, 2019, and claims priority from that application which is also deemed incorporated by reference in its entirety in this application.

STATEMENT REGARDING FEDERALLY SPONSORED RESEARCH OR DEVELOPMENT

Not applicable

BACKGROUND OF THE INVENTION

I. Field of the Invention

The present invention relates to a labeling machine, and more particularly, to a labeling machine especially designed for use in the food, pharmaceutical and medical products industries where the design, construction and materials employed are required to comply with applicable industry and regulatory standards and which facilitates effective cleaning and disinfection of the labeling machine by a variety of methods and without harm to the equipment.

II. Discussion of the Prior Art

Automated, high-speed labeling machines are well-known in the art. Generally speaking, such machines typically feed a continuous web of material, typically a silicone-coated carrier strip having adhesive labels adhered to it at discrete intervals along the length of the carrier strip. The carrier strip and the labels thereon are generally fed from a supply reel to a rewind or take-up reel and with an applicator device disposed between the supply and take-up reels. The products to be labeled move on a conveyor positioned adjacent the labeler as the applicator device separates the labels from the carrier strip and applies them to the products being conveyed. A microprocessor-based control system matches the conveyor speed and the product placement on the conveyor with the movement of the carrier strip so that labels are uniformly placed and positioned on the products carried by the conveyor.

While product-labeling equipment of the type generally described above have been in use in the industry for many years, due to their construction, they fail to meet FDA and other applicable standards for use in the food and other industries where pathogens must be addressed. These standards dictate cleaning and disinfection outcomes for equipment exposed to organic materials, such as food products for human and animal consumption. If the equipment is to be cleaned and disinfected, it necessarily must be taken off-line, which adversely impacts product production, especially if it is to be subjected to pressure washing, and other washing and rinsing operations that are essential to remove soilage and pathogens.

To meet the applicable standards and requirements, applicants have designed a high-speed labeling machine in a way to facilitate effective cleaning and disinfection so as to comply with the applicable standards. The labeling machine of the present invention has been designed so as to comply with existing regulations for equipment that is intended to be exposed to food for humans and other animals. For example, under the provisions of 21 CFR 117.40, all plant equipment and utensils used in manufacturing, processing, packaging or holding food must:

1. Be designed and of such material and workmanship that they are adequately cleanable, and must be adequately maintained to protect against allergen cross-contact and contamination;
2. Be designed, constructed and used appropriately to avoid the adulteration of food with lubricants, fuel, metal fragments, contaminated water or other contaminates;
3. Be installed so as to facilitate cleaning and maintenance of equipment and of adjacent spaces;
4. Have food-contact surfaces that are corrosion resistant when in contact with food;
5. Have food-contact surfaces made of non-toxic material and designed to withstand the environment of their intended use and the action of food, and, if applicable, cleaning compounds, sterilizing agents, and cleaning procedures; and
6. Be maintained so that food-contact surfaces are protected from allergen cross-contact and from being contaminated by any source, including unlawful indirect food additives.

Applicable regulations further include the requirement that any equipment in areas where food is manufactured, processed, packed or held that does not come into contact with food must be so constructed that it can be kept in a clean and sanitary condition. Good manufacturing practices further require that the performance of filling, assembling, packaging and other operations be carried out so that food is protected against allergen cross-contact, contamination and growth of undesirable microorganisms.

In designing its labeling machine for use in the food processing and related industries, the named inventors have designed its labeling equipment to comply with these applicable standards, all as will be further explained in detail in the following description of a preferred embodiment.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
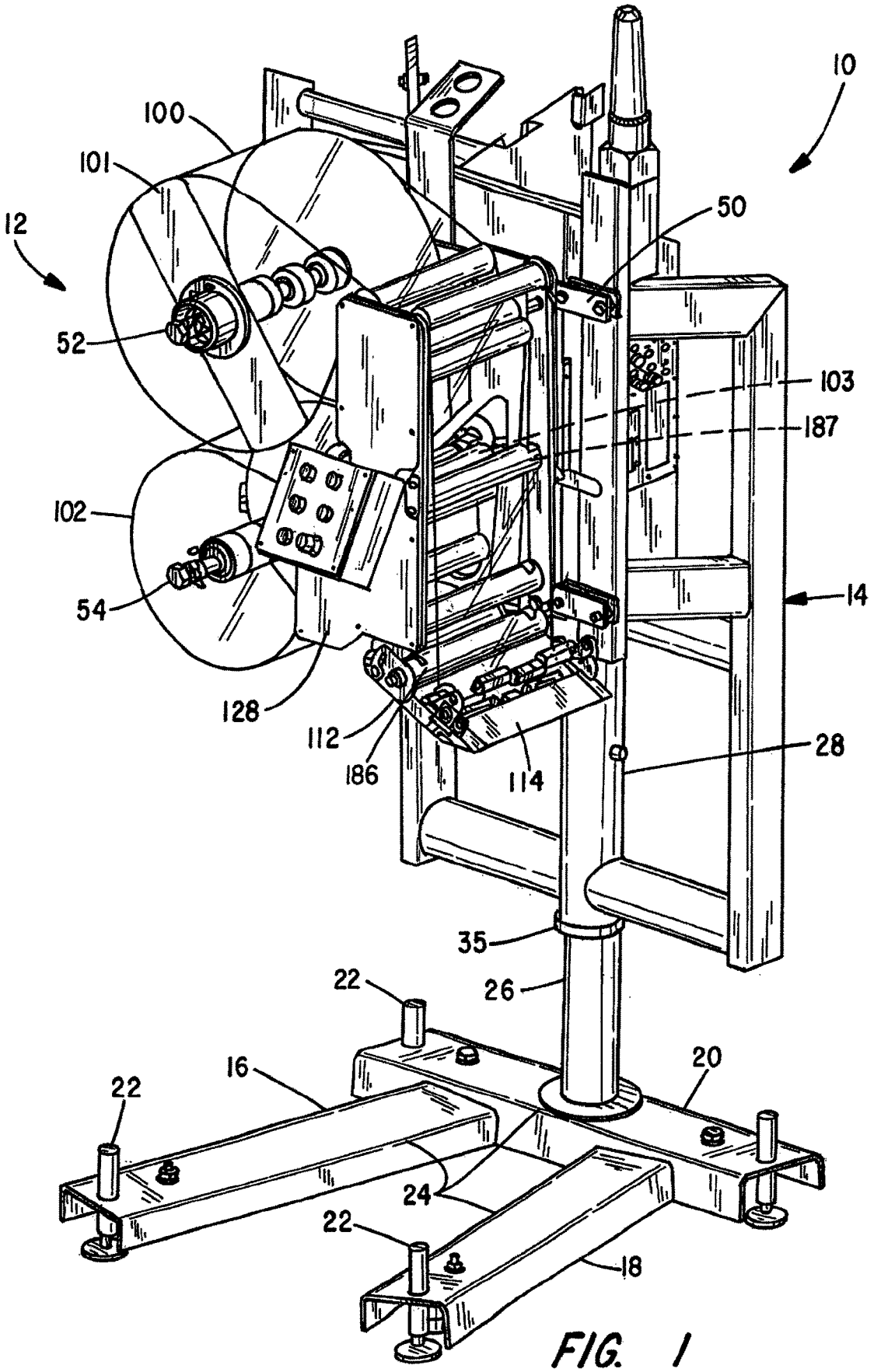
FIG. 1 is a right frontal perspective view of a preferred embodiment of the present invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

With attention directed to FIGS. 1 and 2, a general description of the hygienic labeling machine of the present invention will first be given before going into detail on how the machine has been constructed so as to allow it to be used in production areas where food processing takes place. The machine is identified generally by numeral 10 and comprising a labeler assembly 12 mounted on a jack stand 14.

Considering first the constructional features of the jack stand 14, it comprises a base of a welded, stainless steel construction having three channel segments 16, 18 and 20 connected together as a base as shown. The base also includes jack pads, as at 22, that permit leveling of the labeling machine 10. The base also may be supported on castor wheels for ease of movement at the time of installation at a work site, but are then removed to avoid the necessity of cleaning. The base members 16, 18 and 20 and are preferably sloped with respect to the horizontal to facilitate the drainage of wash water therefrom.

Projecting vertically upward from the base member 20 is a stainless steel tubular post 26 and it has an outside diameter allowing a sliding fit within the lumen of an outer tubular member 28 also of stainless steel. Centrally disposed within the tubular segments 26 and 28 is a conventional threaded lead screw 29 having a traveling nut (not shown) that is threaded onto the lead screw and rigidly fixed to the interior wall of the tubular segment 28. The upper end of the lead screw extends through a sealed ball bearing fitted within a cap or cover plate 30. Shown affixed to it is a removable ratchet crank arm 34. Reference numeral 32 is a ball plunger device that serves to hold the rotational position of the lead screw and ratchet once vertical adjustment of the labeler 12 is set. It needs to be removed during cleaning. A toroidal seal 35 surrounds the lower end of the tubular post 28 and engages the OD of the tubular post 26 to block entry of wash water.

Welded to the exterior wall of the tubular member 28 is a stainless steel frame, indicated generally by numeral 36, that is designed to support the high-speed labeling assembly 12. The frame holds the labeling assembly in a cantilevered position that is adapted to overlay a conveyor (not shown) on which items to be labeled are made to pass. The jack assembly allows the frame to be raised and lowered by manually rotating the lead screw using the crank handle ratchet 34.

Figure 3:
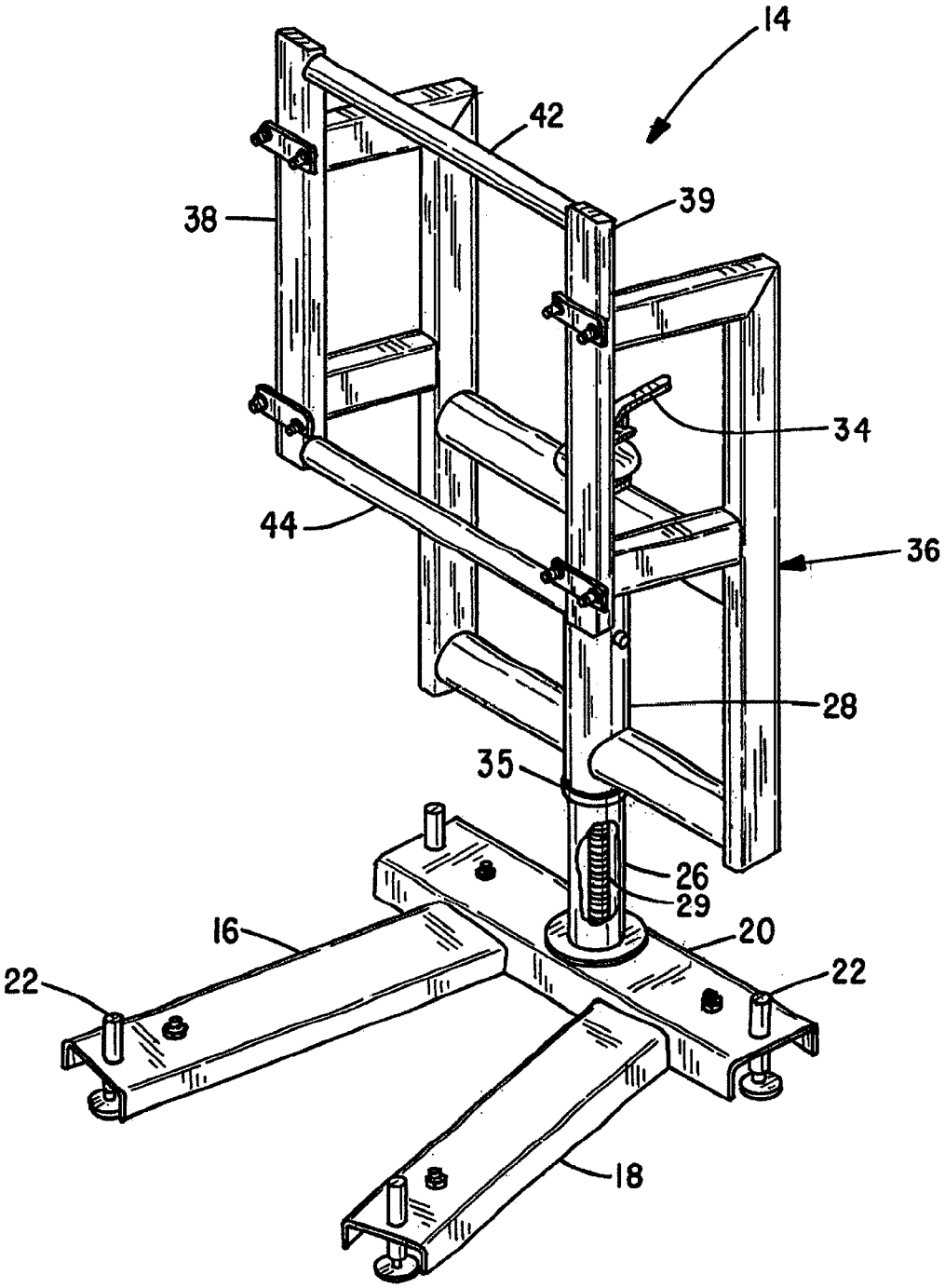
FIG. 3 is a perspective view from the front of the jack stand and frame with the labeler removed.

FIG. 3 is a perspective view of the jack stand and frame assembly with the high-speed labeler module 12 removed therefrom. Here, it can be seen that the welded frame includes a pair of mounting bars 38 and 39 that are held in parallel, spaced-apart relation by round cross struts 42 and 44. Again, the rounded construction of these two struts facilitates cleaning solution drainage therefrom. In FIG. 3, all horizontal surfaces are sloped to facilitate drainage of wash water therefrom. Again, the frame is preferably fabricated from stainless steel members.

Figure 4:
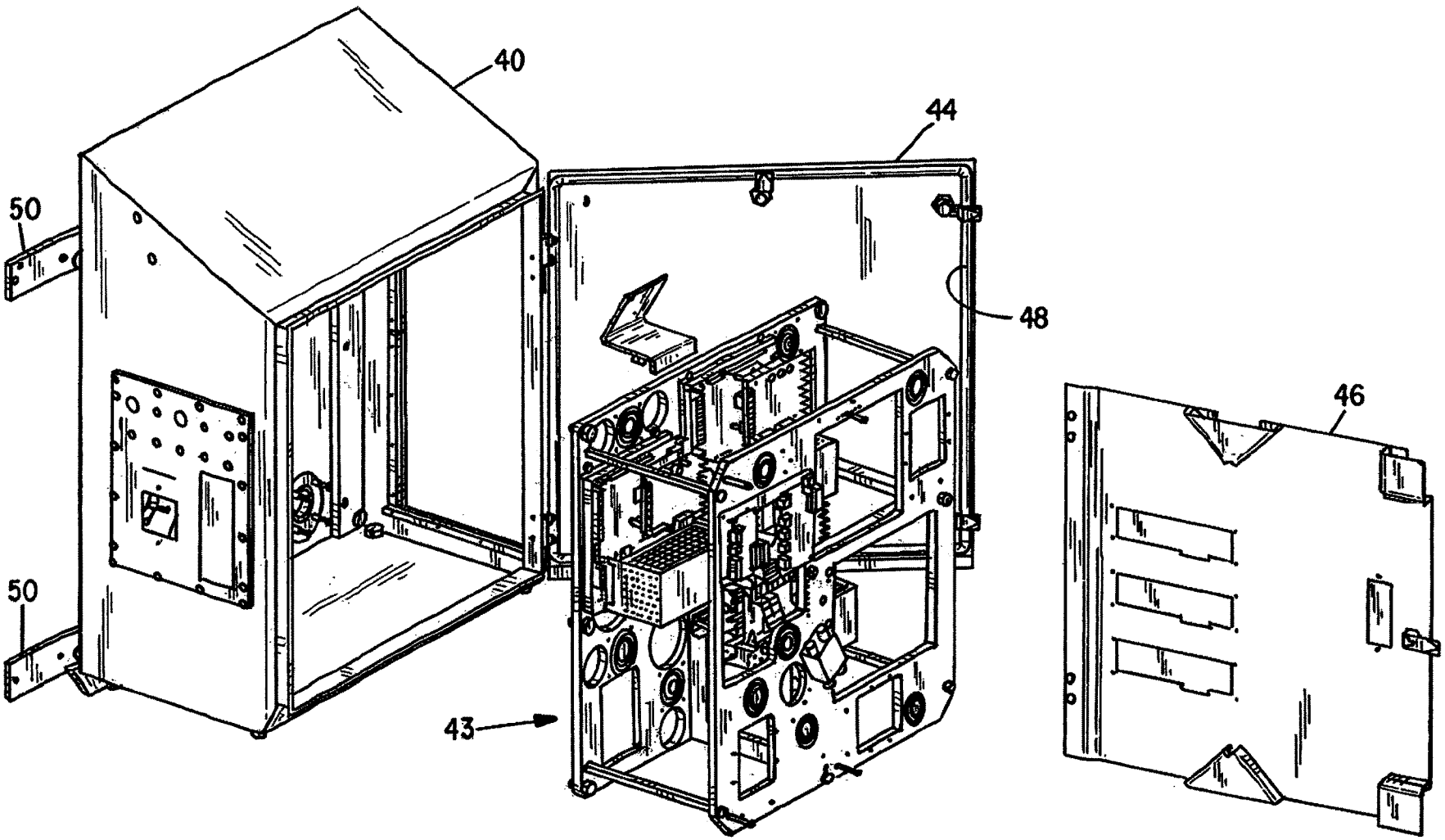
FIG. 4 is an exploded partial view of the enclosure with the internal components removed therefrom.

FIG. 4 is an exploded, partial view showing the enclosure assembly 40 with the internal components removed therefrom and identified generally by numeral 43. These internal components are not subject to hygienic wash down in that when they are contained within the box-like enclosure assembly 40 and when the doors 44 and 46 thereof are closed, the internal components 42 are isolated from moisture invasion given the presence of a "cast-in door" sealing gasket 48 formed about the perimeter of the outer door 44. In fact, as will be further explained, all openings formed in the enclosure assembly 40 are gasketed or otherwise sealed so as to create a waterproof housing.

With continued reference to FIG. 4, fixed to the front face of the enclosure 40 are mounting tabs as at 50 which allows the enclosure 40 to be affixed to the frame assembly members 38 and 39, shown in FIG. 3. The top surface of the enclosure is also sloped from front to rear to facilitate draining of water therefrom.

Figure 2:
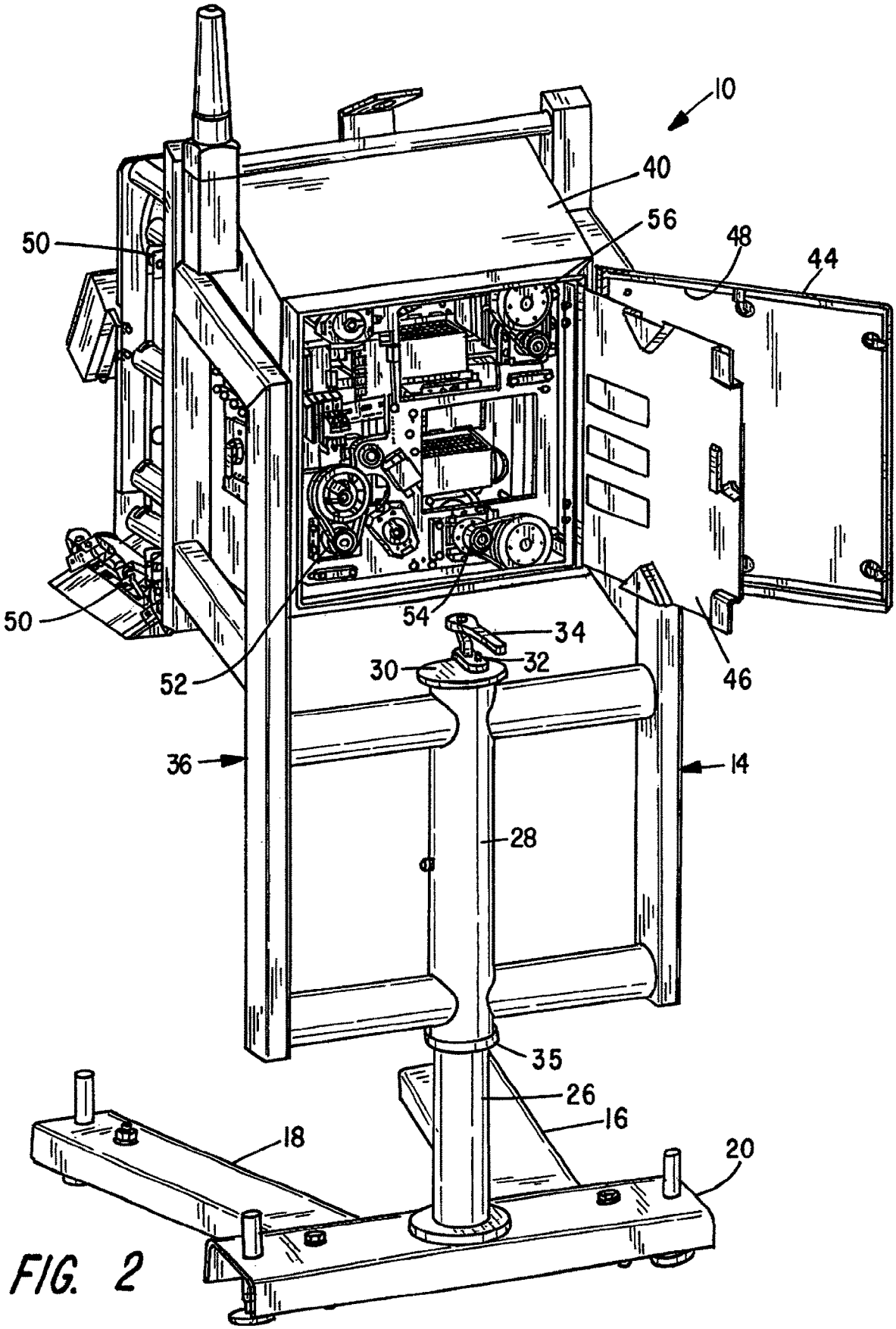
FIG. 2 is a perspective rear view thereof.

With reference back again to the perspective view of FIG. 2, and which shows the outer door 44 and the inner door 46 being open, one can view three servomotor drive assemblies 52, 54 and 56. An output shaft on each of these servomotors supports a toothed sprocket for a timing belt that drives respective sprockets that are mounted on the shafts for a label supply reel 100, a label carrier take-up reel 102 and a driven roller 118 in the pinch assembly that on demand moves to press the carrier material against the pinch roller 103. In FIG. 1, the label carrier web is shown as being transparent so as to allow viewing of the working parts.

In FIG. 1, the shaft for the label supply reel 100 is identified by numeral 52 and the shaft for the label carrier rewind reel 102 by numeral 54.

Figures 5A, 5B:
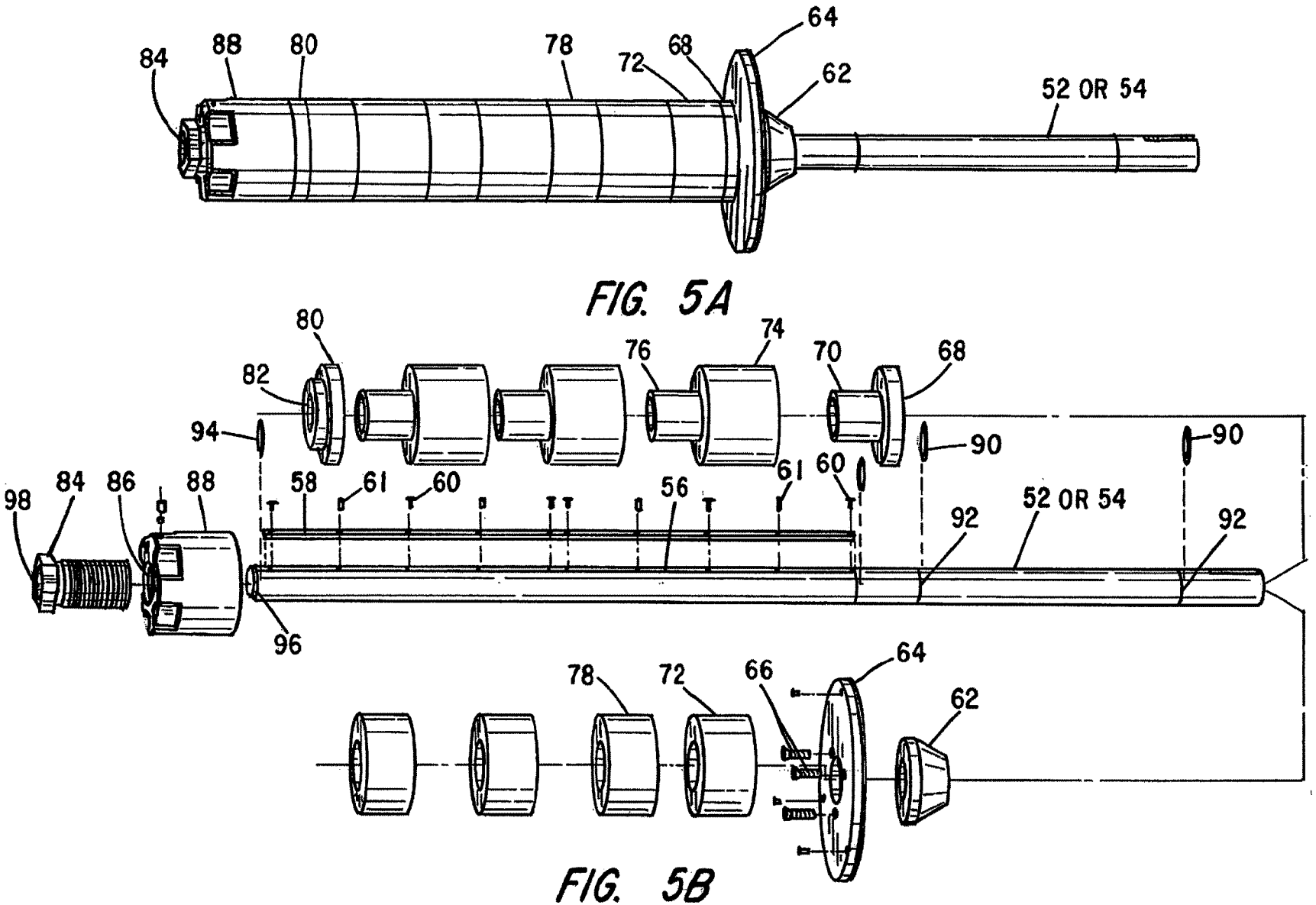
FIG. 5A is a view of the shafts on which the supply reels and return reels are mounted in accordance with a first embodiment.
FIG. 5B is an exploded view of the shaft of FIG. 5A.

FIG. 5A is a view showing the constructional features of the shafts on which the label supply reel and the label carrier rewind reel are mounted in accordance with a first embodiment and FIG. 5B is an exploded view thereof. Each comprises a shaft 52 or 54 having an elongated flat 56 cut therein for mounting an elongated key member 58 therein. The key member 58 is held in place by a plurality of flathead, countersunk screws, as at 60 and dowel pins as at 61. Fitted onto the shaft, and progressing from right to left when viewed in FIG. 5B, are a frusto conical collar member 62 to which a hub 64 is attached by bolts as at 66. Next in line on the shaft are a tubular spacer 68 having a reduced diameter portion 70 onto which is fitted an EPDM closed cell sponge rubber sleeve 72. Next in line on the shaft 52 or 54 is an acetyl spacer member 74 also having a reduced diameter portions 70 and 76 onto which is fitted a further EPDM foam sleeve 78. While the spacer 74 is held against rotation on the shaft by the key 58, the foam member 78 is free to rotate relative to the reduced diameter portion 76.

Two further spacer/foam rubber roller combinations are mounted on the shaft in the manner described and this is followed by another acetyl plastic spacer 80. A handle knob 88 has an internally threaded bore 86 designed to receive an externally threaded portion of a compression applying nut 84 that is keyed to the shaft and is therefore not free to rotate within the central threaded bore 86 of the knob 88.

Those skilled in the art can appreciate that when the hand knob 88 is screwed on to the threaded nut 84 toward the foam parts it will result in the compression and attendant radial swelling or expansion of the series of EPDM foam segments. Thus, when these foam members and associated spacers are fitted within the cylindrical core of a label supply reel or label carrier rewind reel, it will result in the reels rotating with the shafts 52 or 54. When the knob 88 is subsequently turned in a counter-clockwise direction, when viewed from the left as in FIG. 5B, the foam members will return to their uncompressed state allowing the supply reel or take-up reel to be readily removed from their respective shafts.

When the machine is in use, the spacers like 74 and foam rubber sleeves are held in place by removable spring clips, as at 90, that snap into circumferential grooves, as at 92, formed in the shaft. An end spring clip 94 is designed to fit within an end groove 96 once the nut 88 and the compression nut 84 are assembled thereon. A spring clip 94 fits within a pocket 98 formed in the end of the compression nut 84. When it is desired to clean the machine, the spring clip 94 will be removed, allowing the compression nut 84 and the nut 88 to be removed from the shaft 52 or 54 and following that, the spacers and sponges can be slid along the keyway and removed from the outer end of the shaft while leaving the shaft in place. The separated components that mount to the shaft can then be individually cleaned separate from the shaft on which they are otherwise mounted.

Figure 5C:
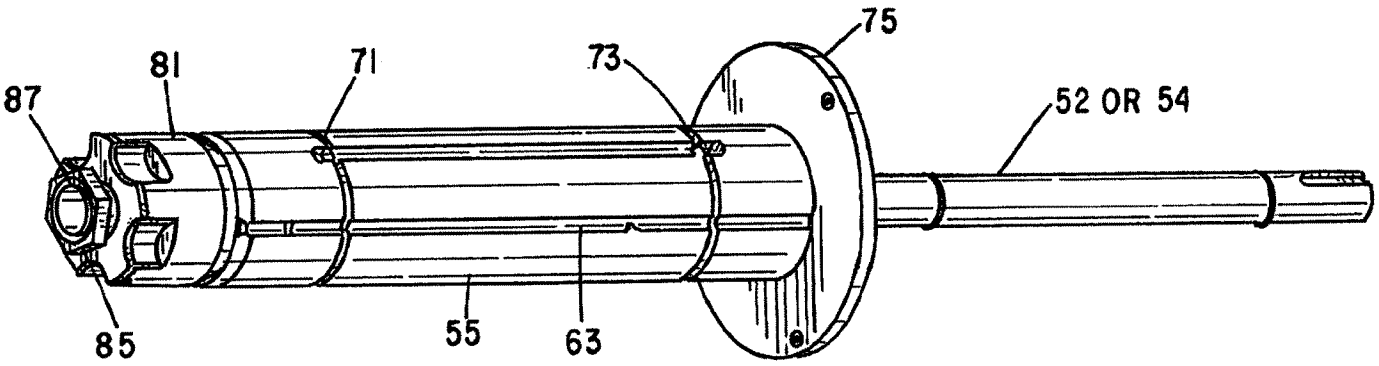
FIG. 5C is a view of the shafts on which the supply reels and return reels are mounted in accordance with a second embodiment.
Figure 5D:
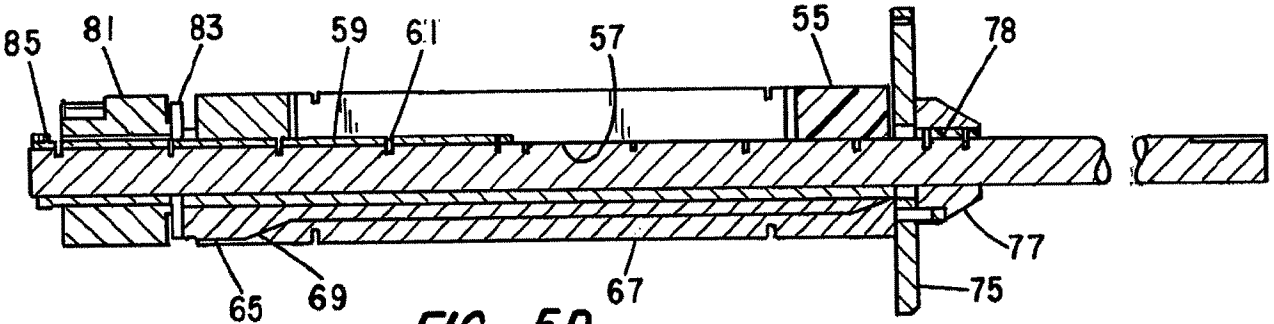
FIG. 5D is a longitudinal cross sectioned view of FIG. 5C.

FIG. 5C is a perspective view of an alternative arrangement for releasably gripping label web supply reels and label web take-up reels to their respective servo-driven shafts 52 and 54 and FIG. 5D is a cross-sectional view thereof. As seen, fitted onto these two shafts is a cylindrical plastic sleeve 55 of a predetermined outer diameter corresponding to the OD of the tubular core on which label carrying plastic or Teflon coated paper webs are conventionally sold. A longitudinally extending central bore 57 permits the sleeve 55 to be fitted onto the shafts 52 and 54. To ensure that the sleeves will rotate with the shaft, a key 59 is bolted to the shaft 52, 54 by a plurality of flathead stainless steel screws, as at 61.

Formed through the wall of the tubular sleeve is a plurality of elongated, radially-extending, regularly circumferentially spaced slots, one of which is seen in FIG. 5C and identified by numeral 63. Contained within these slots, preferably three at 120° spacing, are a pair of wedge plates, namely, an inner wedge plate 65 and an outer wedge plate 67. As seen in FIG. 5D, the inner wedge plate 65 has a camming surface 69 formed thereon that abuts a sloped left end of the outer wedge plate 67. Further, the rightmost end of the inner wedge plate 69 is tapered to mate with a correspondingly tapered rightmost end portion of the outer wedge plate 67.

The wedge plates are retained in their associated slots by elastic O-rings 71, 73 fitted into circumferential grooves formed in the outer surface of the sleeve 55.

A hub 75 and a collar 77 are also keyed so as to rotate with the shaft 52 or 54 by a key 79 located proximate the right end of the sleeve, as seen in FIG. 5D.

Mounted on a threaded left end portion of the shaft is a manually grippable enlarged, internally threaded nut 81. It can be seen that when the threaded nut 81 is rotated clockwise on the shaft, it will move to the right and thereby press a cap member 83 against the ends of the inner wedge plates 65 moving them to the right, as seen in FIG. 5D, to thereby force the outer wedge plates 67 radially outward to engage the ID of a core of the supply and take-up reels and cause the reels to rotate with the shaft. When it is desired to release a reel so it can be removed and replaced, the nut is rotated back counterclockwise, removing the force from the ends of the inner wedge plates 69, allowing the elastic O-rings 71 and 73 to contract and move the outer wedge plates 67 to recede back out the confines of the slots in the sleeve.

The sleeve and wedge plates, along with the hub and collar can be removed from the shaft for cleaning by first unscrewing a compression nut 85 and a retainer clip 87 from the left end of the shaft.

Irrespective of which implementation for releasably locking a reel of label carrying web is used, as seen in FIG. 1, a flange plate 101 for retaining the reel is mounted for longitudinal adjustment on the shaft 52 to accommodate label web supply reels of differing width dimension. The flange 101 is bolted to the hub assembly that slides onto the sleeve 55 and set screws or bolts are used to hold the flange at a position abutting the reel.

Figure 6:
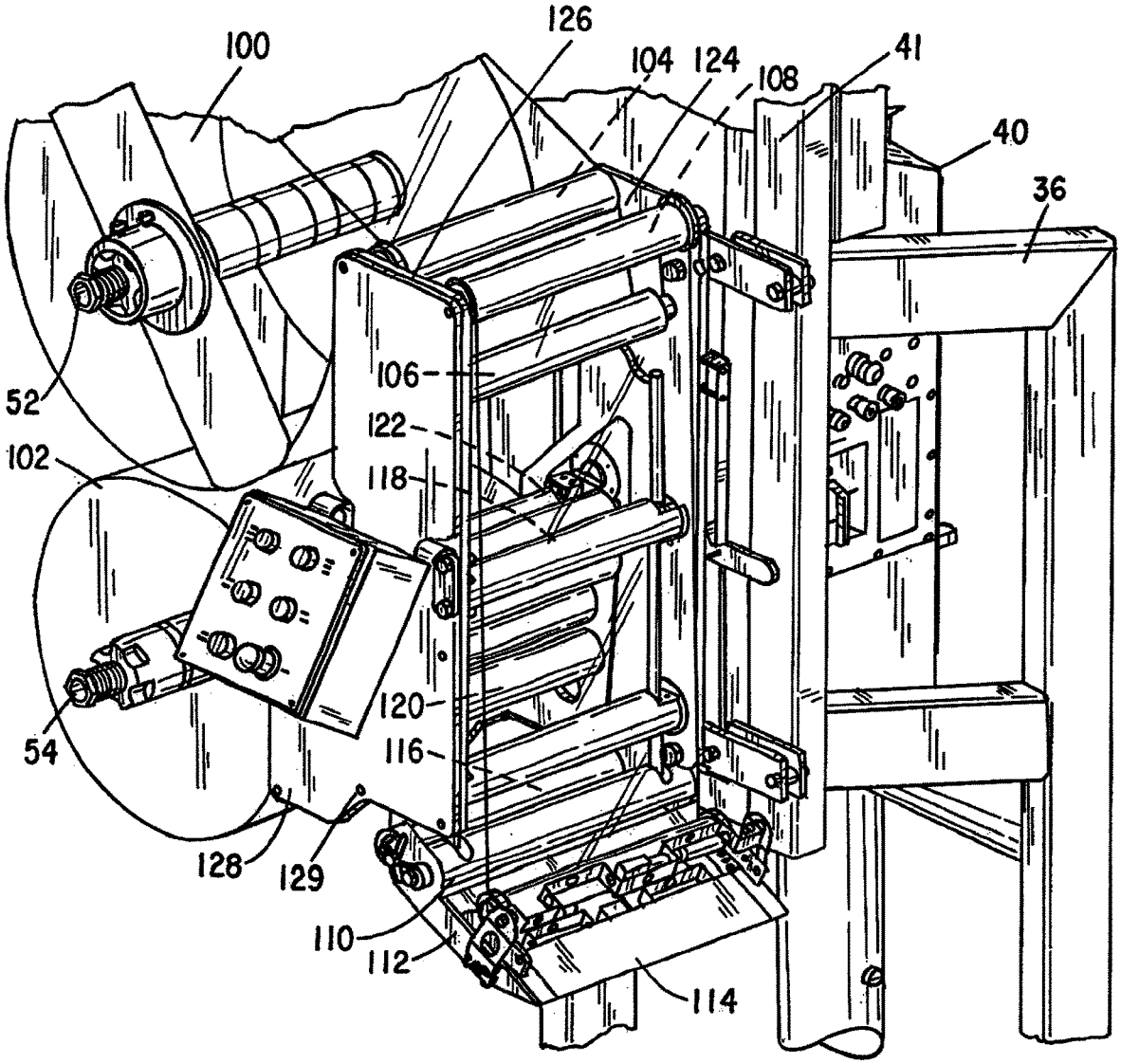
FIG. 6 is a partial perspective view of the labeler module illustrating the routing of the carrier web.

Turning next to FIG. 6, which shows a partial view of the machine isometrically, the label carrier is again shown as being transparent so as to better illustrate its routing and progression from the supply reel 100 to the take-up or rewind reel 102 without obscuring the rollers used to route the web through the labeler assembly 12. As shown, the label carrier web first passes over an idler roller 104 and then under an upper dancer roller 106 and then up and back over a further idler roller 108. The carrier web then heads downward, passing beneath an idler roller 110 mounted on a peel plate assembly 112 and, thence, about a sharp edge 114 of a plate where peeling of a label from its carrier web takes place. The carrier web then traverses an idler roller 116 mounted on the rear of the peel plate assembly 112 and then between a pinch roll 103 and drive roller 118 (FIG. 7) forming a pinch assembly. It then continues under a lower dancer roller 120, thence over an idler roller 122 and onto the web carrier rewind reel 102.

As was earlier mentioned, a servo motor drives the drive roller 118 in a pinch assembly that can be made to grip the label carrier web and aid in moving this web through the above described tortious path.

With the continued reference to FIG. 6, aforementioned rollers 104, 106, 108, the members of the pinch roller assembly 118 and the idler roller 120 are journaled for rotation between a support plate 124 and a roller mounting plate 126 that is overlaid by a stiffener guard member 128. The stiffener guard member 128 is fastened to the roller mounting plate by a series of bolts, as at 129 in FIG. 6, that first pass through a pair of elastomeric sealing washers, a tubular spacer or stand-off between the stiffener guard member and the roller mounting plate before the bolts enter threaded bolt holes in the roller mounting plate.

Figure 7:
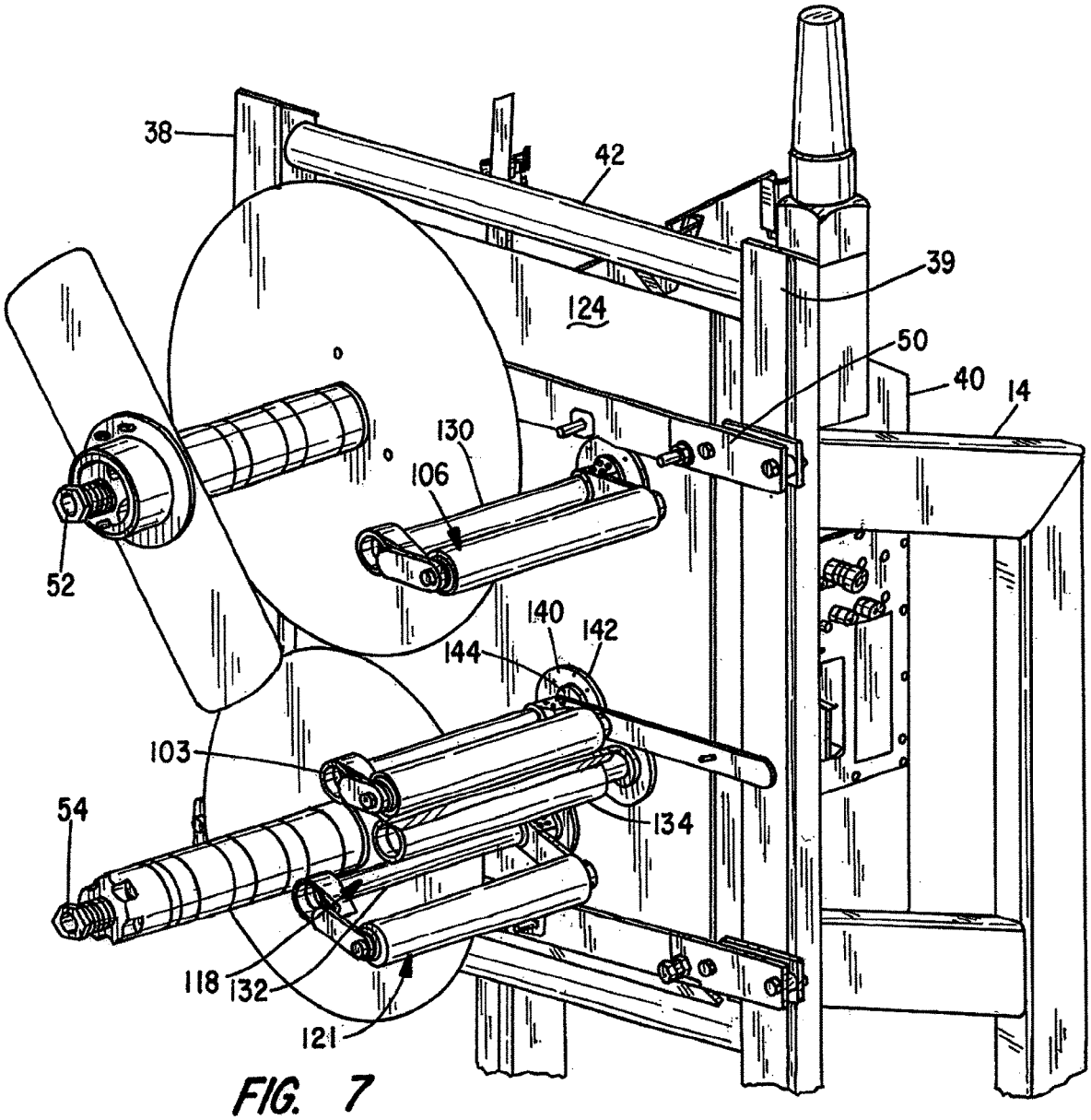
FIG. 7 is a partial perspective view from the front of the labeler assembly and with the roller mounting plate and stiffener and guard member removed.

In the view of FIG. 7, several parts are shown as missing to allow additional clarity. Here, the support plate 124, the roller mounting plate 126 and the stiffener guard member 128 are removed to better illustrate the manner in which the shafts 130 and 132 of the upper and lower dancer assemblies 106 and 121 and the driven shaft 134 of the pinch roll assembly 118 penetrate through the back wall of the housing 40 in a manner that precludes entry of wash water into the interior of the housing. Bolted to the support plate 124 surrounding apertures (not shown) formed through the support plate are bearing retainers as at 140 having an O-ring 142 compressed between it and the back wall of the housing.

Surrounding each of the driven shafts and centered within apertures in the bearing support plate is a bearing isolator, as at 144, on the shaft of the pinch roller. Without limitation, the bearing isolator may be a PUR-GARD™ available from Garlock Sealing Technologies of Palmyra, N.Y., which has been approved for use in the food and beverage processing industry and manufactured with materials that are FDA compliant. They are designed to include a labyrinth seal that precludes entry of fluids and solids. This seal construction on the shaft of the pinch roller assembly is typical of what is used with the unwind and rewind shafts 52, 54 and the upper and lower dancers 106 and 120.

Figure 8:
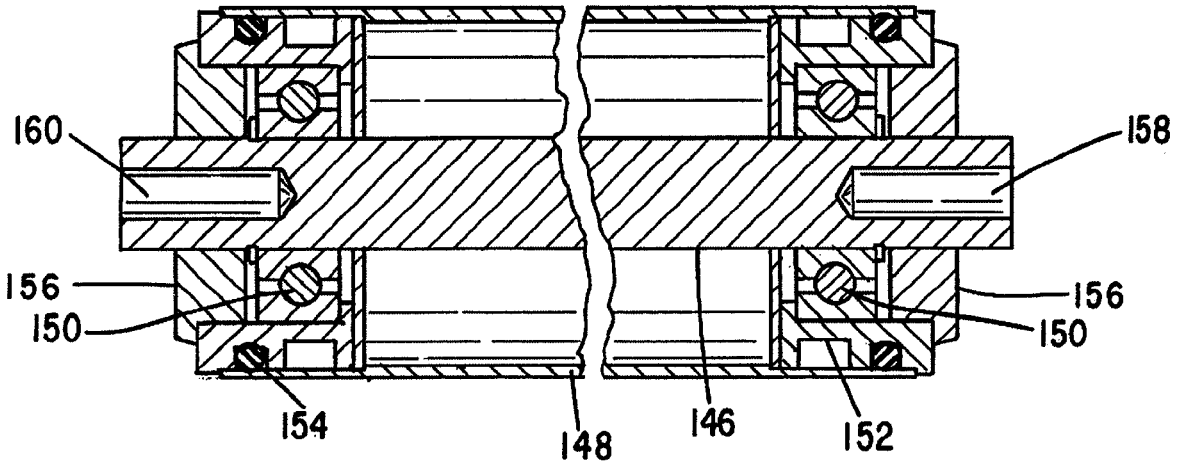
FIG. 8 is a longitudinal cross-sectional view of the idler rollers employed in the preferred embodiment.

The idler rollers 104 and 108 are constructed as seen in the cross sectional view of FIG. 8. Further, an idler roller shaft 146 is concentrically journaled within an idler roller tube 148 by ball bearings 150 that are supported by annular end caps 152 that fit between the bearings and the roller tube 148. O-rings, as at 154, form a seal between the end caps and the roller tube. Bearing isolators 156 that surround the shaft 146 and fit within the roller end caps 152 serve to preclude entry of cleaning fluids into the interior of the idler rollers. Thus, they need not be disassembled from the labeler module during cleaning.

With continued reference to FIG. 8, the shaft 146 has longitudinally extending bores 158 and 160 at opposed ends thereof for fastening the idler rollers between the mounting plate 124 and the backing plate 126, as seen in FIG. 6.

The present label carrier web drive and tensioning system maintains uniform web tension as the supply reel and take-up reel diameters vary as the web unwinds from the supply spindle and rewinds on the label carrier take-up spindle. Furthermore, it enables more rapid acceleration/deceleration of the web by minimizing the inertial effects of the servo driven supply and take-up reels through the use of spring loaded position Sensor dancing arms for both the carrier web supply and the web take-up spindles control the web tension. The web pincher assembly provides additional motive force to move the label web over the resistance imparted to the web by the label peel assembly.

Figure 9:
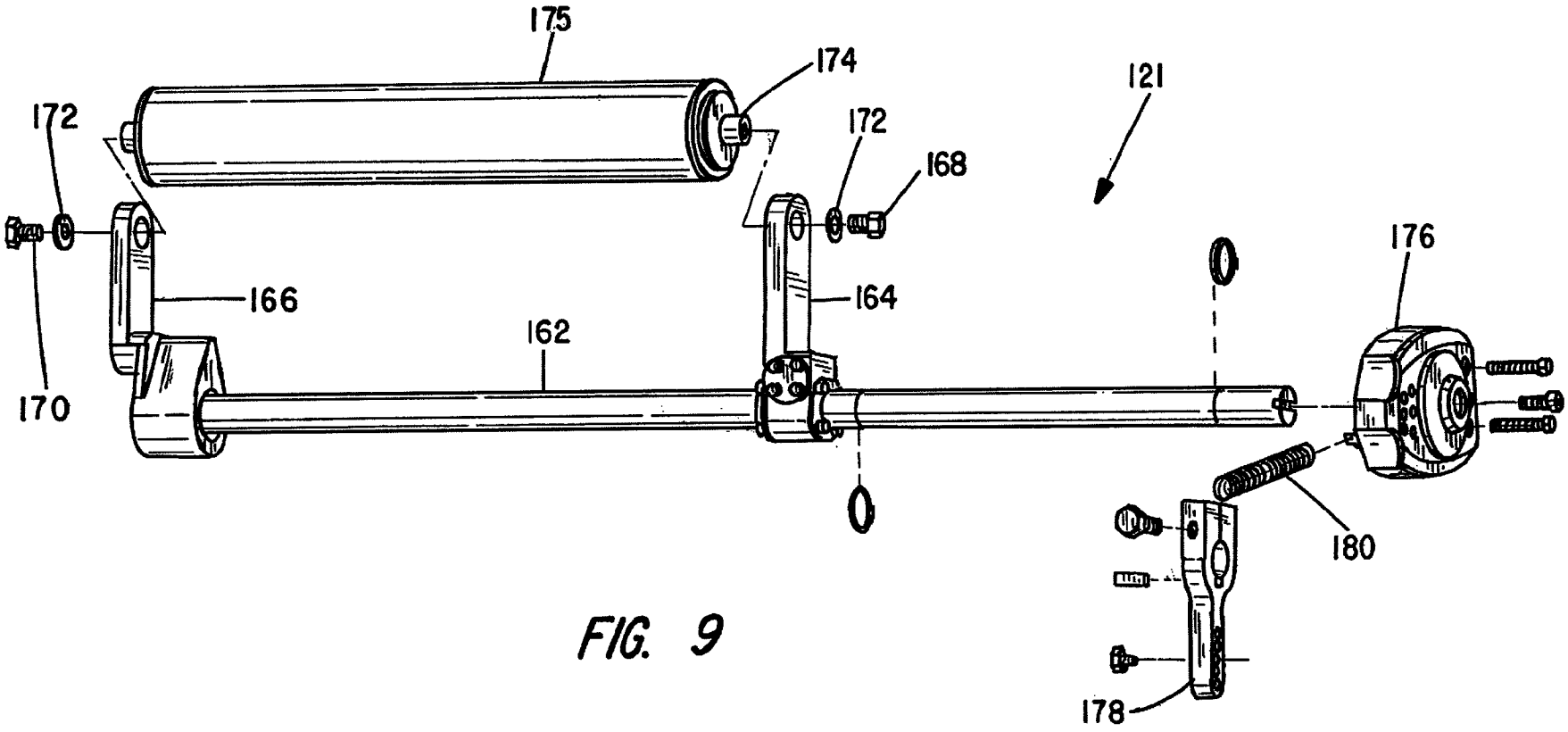
FIG. 9 is an exploded view of the lower dancer assembly.

The labeler device of the present invention incorporates a dancer roll system that acts as take-up mechanisms to compensate for the different speeds between unwind/rewind rolls and the drive roll which index labels across the peel assembly. FIG. 9 is an exploded view of the lower dancer assembly 121, shown in FIG. 7. It comprises an elongated dancer arm shaft 162 having spaced apart arms 164 and 166 between which is journaled the idler roller 120. As is the case with the idler rollers 104, 106 and 108, ball bearings are disposed within the roller 120 allowing it to freely rotate when held in place by bolts 168 and 170 that extend through sealing washers 172, the arms 164 and 166 and into threaded bores formed in the ends of a roller shaft 174.

Affixed to the free end of the shaft 162 is a position sensor 176. Without limitation, the position sensor may be an angular measuring device manufactured and sold by the Pepper & Fuchs Group having a place of business in Twinsberg, Ohio. The right end portion of the shaft 162 extends through hermetically sealed bearings within the housing such that the sensor 176 is not exposed to moisture during pressure washing operations. Also, as previously described, because of the manner in which the roller 175 is journaled, it too precludes seepage of moisture or solid debris into it. Mounted on the right most end of the shaft 162 is the spring loaded arm 178. The spring 180 connected to the arm provides biasing force that presses the roller 120 against the label carrier web so that as the web tension changes as the label carrier unwinds from the supply rail and onto the rewind reel, the sensor provides output signals to a controller for one or more of the aforementioned unwind and rewind servo motor drives to adjust the speed thereof as the diameters of the supply and rewind spools vary. In that the upper dancer assembly 106 is substantially the same in construction as the lower dancer assembly having the roller 120, it will not be necessary to repeat a description of its construction.

Figure 10:
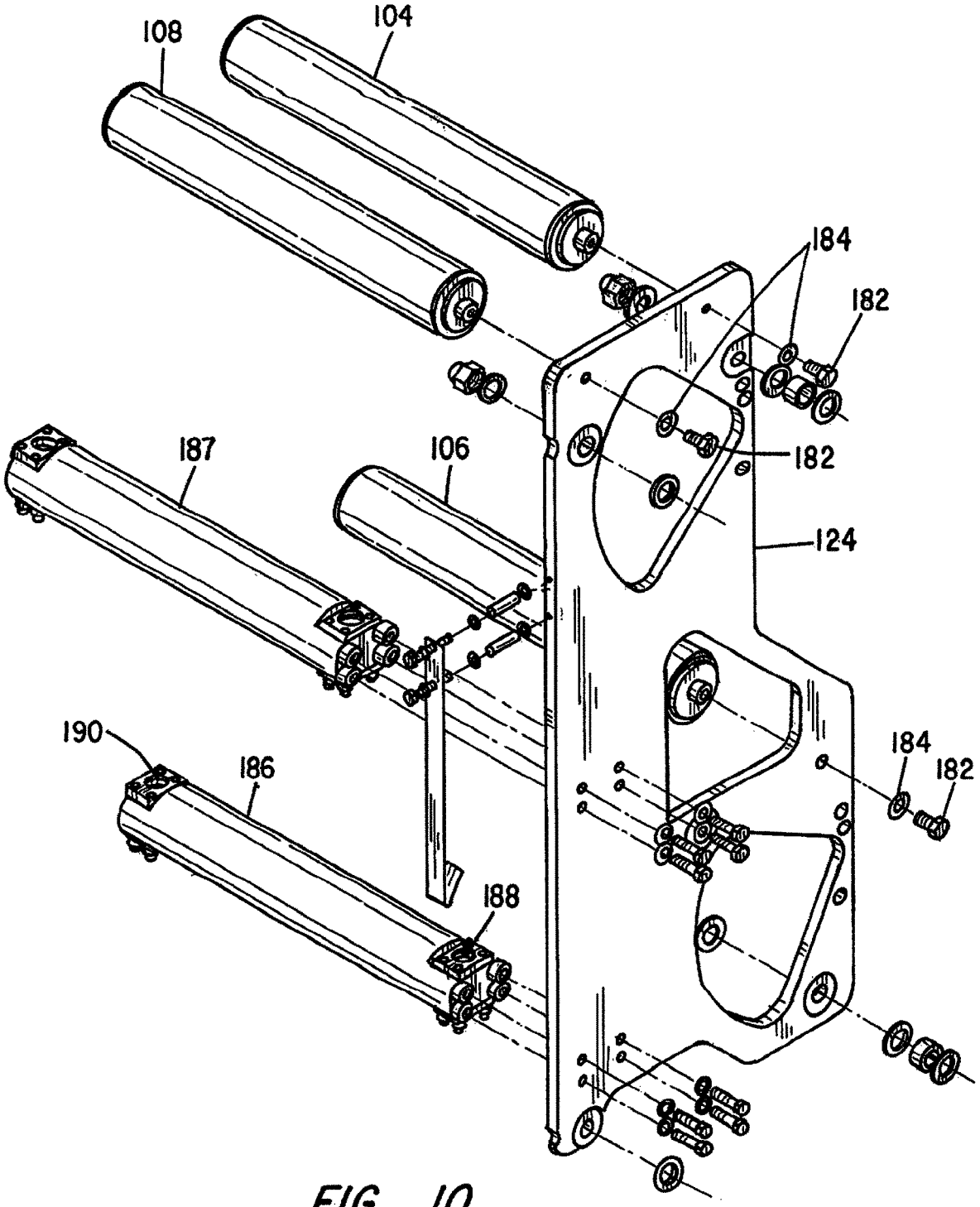
FIG. 10 is an exploded partial view showing how roller and guide components are joined to the labeler's support plate.

Next to be described is the label peel assembly 112 shown in FIGS. 10 and 11A-11D. FIG. 10 is an exploded view showing the manner in which idler rollers 104, 106 and 108 are attached to the support plate 124 using bolts, as at 182, and sealing washers, as at 184, to secure the idler rollers to the plate. Also shown attached to the support plate 124 are stationary posts 186 and 187 that are joined to the support plate 124 by combinations of four bolts and four sealing washers for each of the posts. As seen in FIG. 10, posts 186 and 187 have vertically aligned bores proximate the opposed ends of the posts and identified by numerals 188 and 190. As already mentioned, the aforementioned idler rollers 104, 106, 108 and the posts 186 and 187 fasten at one end to the support plate 124 and at the opposite end to the backing plate 126 (FIG. 6).

Figure 11A:
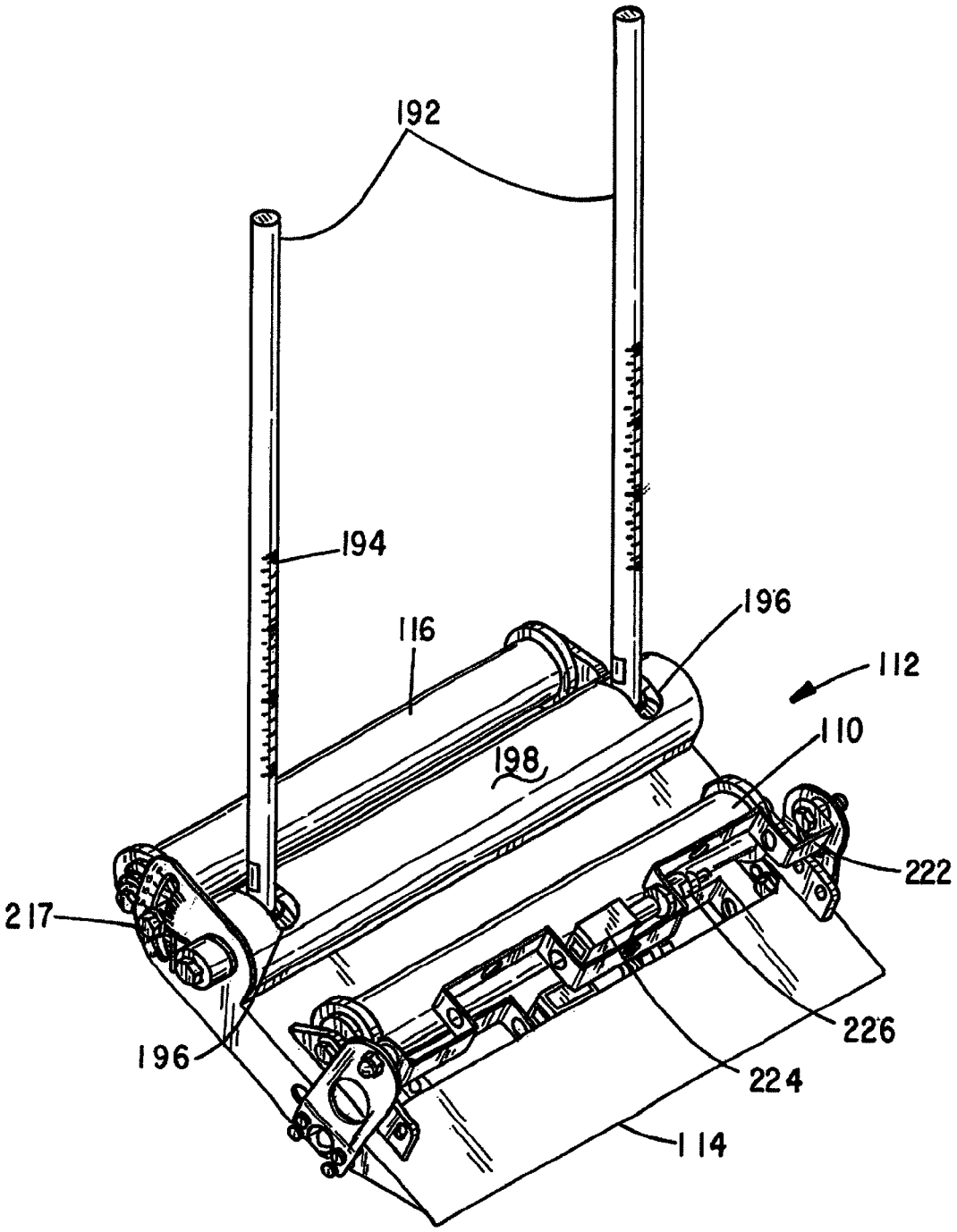
FIG. 11A is a perspective top view of the labeler's peel plate assembly.

As can be seen in FIG. 1, extending vertically through aligned apertures 188 and 190 of the posts 186 and 187 are a pair of rods 192. In FIG. 11A, these rods are shown as forming part of the peel plate assembly 112. The rods 192 have scale markings 194 thereon that facilitate positioning of the peel plate assembly 112 relative to products to be labeled that are made to pass beneath the cantilevered labeler mechanism 12.

Figure 11B:
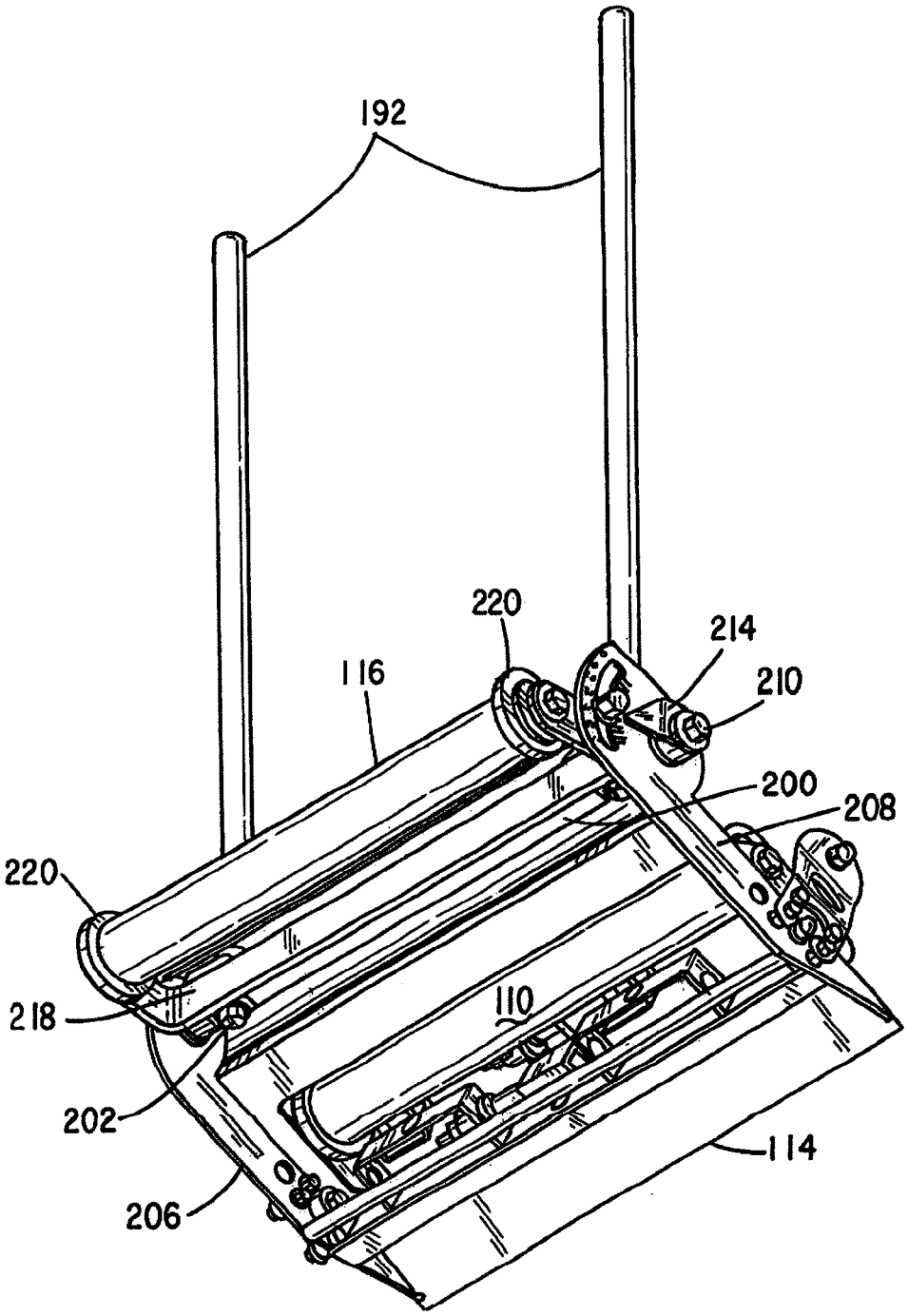
FIG. 11B is a perspective bottom view thereof.
Figure 11C:
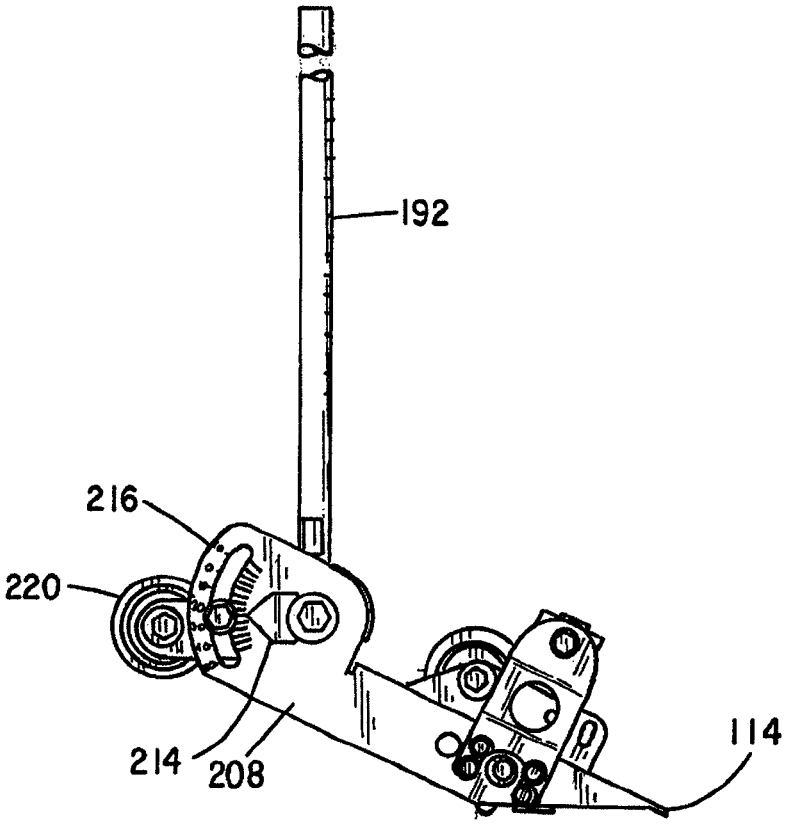
FIG. 11C is a side view thereof.
Figure 11D:
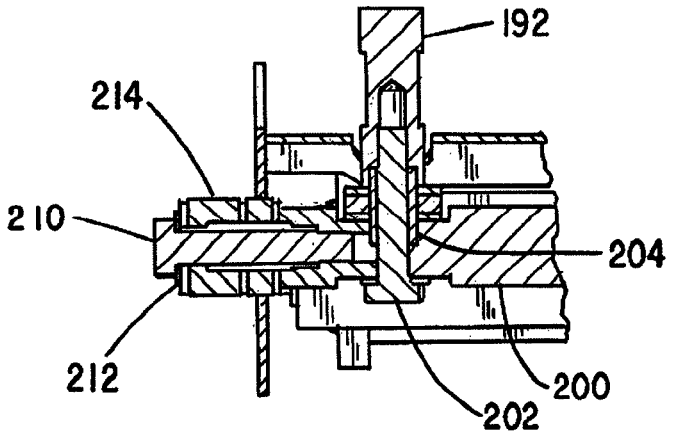
FIG. 11D is a cross-section view taken along the line A-A in FIG. 11C.

The rods 192 extend through slots 196 in an arcuate cover member 198 and fastened to a pivot rod 200, (FIGS. 11B and 11D). More particularly, a stainless steel bolt 202 extends upward through sealing washers and through a hollow pin 204 into the lower end of the rod 192. Pivot rod 200 extends between left and right side plates 206 and 208 that are secured thereto by end bolts 210. These bolts first extend through sealing washers 212 and a scale pointer 214 that cooperates with scale markings 216 on the end of the side plate 208. It can be seen that when the bolt 210 and the nut 217 (FIG. 11B) are loosened, the angle of inclination of the peel plate 114 relative to the vertical posts 192 can be set.

The idler roller 116 is journaled for rotation in a U-shaped bracket 218, as seen in FIG. 11B. This idler roller is constructed in the same fashion as is shown in FIG. 8, but further includes web guides 220 on opposed ends thereof that serve to preclude lateral movement of the web.

In FIG. 11A, shown mounted atop the peel plate assembly 112 is a sensor mounting bracket 222 having a zigzag configuration for mounting a plurality of label sensors, as at 224. A bolt arrangement and a shaft connected to the sensor and identified by numeral 226 allows for angular adjustment of the optical sensor 224. The sensor 224 is designed to produce an electrical signal upon detection of labels on the carrier web.

By providing shaft seals as described with the aid of FIG. 7 and gasketing on the housing of FIG. 4, along with the use of sealing washers on all bolts entering the enclosure 40, moisture during periodic washing is precluded from entering the enclosure 40. Thus, the drive motors, sensors and associated electronic circuitry contained therein are maintained immune from moisture damage. Likewise, by constructing the several idler rollers employed, as explained with the aid of FIG. 8, they need not be removed from the labeler during wash down. Also, as explained with the aid of FIGS. 5A and 5B, the rollers on which the supply reel of labels and the rewind reel can be readily disassembled for cleaning without need for removing their shafts from the labeler assembly. Furthermore, the jack stand and associated mounting frame are of a stainless-steel construction with sloping or rounded horizontal surfaces to enhance drainage therefrom and employ appropriate seals at joint areas to inhibit entry of fluids.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A machine for applying labels to articles flowing on a conveyor, said machine comprising:

(a) a support stand adapted to support a labeler assembly in cantilevered relation above a conveyor;

(b) the labeler assembly including an enclosure assembly having a top wall, a bottom wall, a front wall, a rear wall and a pair of opposed side walls and an access door incorporating a gasket in the rear wall for preventing ingress of moisture when the access door is closed relative to the enclosure assembly;

(c) a plurality of servo motors disposed within the enclosure assembly;

(d) a plurality of rotatable shafts extending through the front wall of the enclosure assembly, a first of said shafts adapted to support a label web supply reel and a second of said shafts adapted to support a web take-up reel, a third of said shafts having a label web drive roll thereon and a fourth of said shafts mounting a pinch roller assembly, each of said first, second, third and fourth shafts passing through an associated bearing isolator mounted to the enclosure assembly and each having a seal for inhibiting passage of moisture along the shafts into the enclosure assembly;

(e) means for coupling the plurality of servo motors individually to the plurality of shafts within the enclosure assembly;

(f) a peel plate assembly joined to the support stand; and (g) a plurality of idler rollers journaled for rotation on a support plate fastened to the support stand and disposed adjacent to the front wall of the enclosure assembly for routing a flexible, label-carrying web over a path of travel from the web supply reel, through the pinch roller assembly and over the web drive roll and about the peel plate assembly back to the web take-up reel.

2. The machine of claim 1 and further including a pair of dancer assemblies affixed to the support plate and extending into said path of travel for sensing web tension and providing speed control signals to the servo motors driving the first and the second of said shafts.

3. The machine of claim 2 wherein the enclosure assembly is formed from stainless steel and has a sloping top wall surface.

4. The machine of claim 2 wherein the pair of dancer assemblies each include an elongate shaft having first and second ends; a sensor module affixed to the first end and a first roller mounting bracket affixed to the second end; a second roller mounting bracket affixed to the elongate shaft intermediate the first and second ends; and a dancer roller journaled for rotation between the first and second mounting brackets with the dancer roller including a set of ball bearings and bearing isolators at opposed ends thereof.

5. The machine of claim 4 wherein the elongate shaft extends through a seal in an opening in the front wall of the enclosure assembly such that the sensor module is disposed within the enclosure assembly and the dancer roller is adapted to engage the label web external to the enclosure assembly.

6. The machine of claim 1 wherein the support stand includes a base, a tubular post projecting vertically from the base and a support frame including a second tubular post slidably mounted on the first tubular post and a lead screw and traveling nut operatively coupled between the first and second tubular posts for raising and lowering an enclosure mounting frame to which the enclosure assembly is attached relative to the base upon rotation of the lead screw.

7. The machine of claim 6 and further including a seal member for preventing moisture from entering a clearance space between the first and second tubular posts.

8. The machine of claim 6 wherein the base includes a pair of leg members joined at one end to a cross bar from which the first tubular post projects and where a top surface of the legs and the cross bar are sloped relative to the horizontal to facilitate drainage of cleaning water therefrom.

9. The machine of claim 8 wherein the leg members, the cross bar and the first tubular post are formed from stainless steel.

10. The machine of claim 6 and further including a cap for covering an upper end of the second tubular post and a removable ratchet crank for engaging a protuberance on an end of the lead screw that extends through a seal in the cap for rotating the lead screw.

11. The machine of claim 1 and further including means located on the first shaft for releasably gripping a core of the label web supply reel and means located on the second shaft for releasably gripping a core of the label web take-up reel and wherein the means for releasably gripping are configured to be removable from the first and second shafts for cleaning.

12. The machine of claim 11 wherein the means for releasably gripping include a plurality of elastomeric sleeves surrounding the first and second shafts that expand radially upon application of a longitudinal compressive force thereto.

13. The machine of claim 11 wherein the means for releasably gripping include a cylindrical sleeve of a predetermined outer diameter and having a central longitudinal bore for receiving one of the first and second shafts, the sleeve being keyed to the one of the first and second shafts for rotation therewith and including a plurality of elongated, radially-extending, regularly circumferentially spaced slots therein, each of said slots receiving an inner wedge member and an outer wedge member, a hub keyed to the one of the first and second shafts at a first end of the sleeve and a manually rotatable nut on a threaded outer end portion of the one of the first and second shafts whereby rotation of the nut in a clockwise direction displaces the inner wedge members longitudinally in the slots to thereby force a portion of the outer wedge member radially out of the slots to engage the core of a reel on one of the first and second shafts.

14. The machine of claim 13 and further including at least one elastic band disposed about the sleeve for retaining the wedge members within their respective slots while permitting the outer wedge member to be displaced radially out of the slots.

15. The machine of claim 1 wherein said idler rollers comprise:

(a) a central elongate shaft of a predetermined diameter;

(b) a tubular roller member of an internal diameter greater than said predetermined diameter of the central elongate shaft;

(c) a set of ball bearings disposed proximate opposed ends of the tubular roller member between the central elongated shaft and the tubular roller member; and (d) bearing isolators mounted on the central elongate shaft having a seal member to inhibit passage of moisture through the ball bearing sets and into an interior of the tubular roller member during wash down of said machine.

16. The machine of claim 1 wherein said peel plate assembly comprises:

(a) a plate member having a web-engaging forward edge and opposed downwardly depending, spaced-apart sides;

(b) a pivot rod extending between the spaced-apart sides of the peel plate assembly;

(c) a pair of elongate mounting rods attached to the pivot rod and extending perpendicularly therefrom; and (d) first and second idler rollers journaled for rotation between the spaced-apart sides of the peel plate assembly whereby the label web, in passing under the first idler roller and over the second idler roller is made to traverse the web-engaging forward edge of the plate member to effect peeling of labels from the web.

17. The machine of claim 16 wherein the pair of mounting rods is adjustably attached to at least one support post affixed to and extending horizontally from the support plate so as to allow a spacing between the peel plate and an item to be labeled to be varied.

18. The machine of claim 16 wherein the first and second idler rollers on the peel plate assembly include bearings and bearing isolators for journaling them between the downwardly depending sides of the peel plate assembly to preclude entry of moisture into an interior of the first and second idler rollers.

19. The machine of claim 17 wherein an angle of inclination of the peel plate is adjustable about the pivot rod.

* * * * *